United States Patent [19]

McMichael

[11] Patent Number: 4,792,386

[45] Date of Patent: Dec. 20, 1988

[54] METHOD AND APPARATUS FOR INSTALLING A LARGE, PLANAR, DELICATE MEMBRANE IN AN ELECTROLYSIS CELL

[75] Inventor: James W. McMichael, Lake Jackson, Tex.

[73] Assignee: The Dow Chemical Company, Midland, Mich.

[21] Appl. No.: 818,465

[22] Filed: Jan. 13, 1986

[51] Int. Cl.[4] ..... C25B 9/00

[52] U.S. Cl. ..... 204/279

[58] Field of Search ..... 204/98, 279

[56] References Cited

U.S. PATENT DOCUMENTS 3,335,079 8/1968 Nellen ..... 204/279

4,170,535 10/1979 Smura ..... 204/295

*Primary Examiner*—John F. Niebling

*Assistant Examiner*—Steven P. Marquis

[57] ABSTRACT

A method and apparatus for installing a sheet membrane in an electrolysis cell is disclosed. In the procedure, a rectangular sheet is first soaked in a selected wetting liquid preliminary to installation, one edge of the rectangular sheet is grasped in a lengthwise rigid releasable clamp, that edge is then positioned through a slot to extend the sheet member from a transport cylinder whereupon the sheet is rolled around the cylinder. This leaves an exposed marginal edge on the sheet which is clamped in a second and similar clamp. This then enables the sheet to be transported and positioned above a slot where the sheet is unrolled and positioned through the slot into an electrolysis cell. Suitable apparatus is also disclosed.

4 Claims, 1 Drawing Sheet

FIG. 1
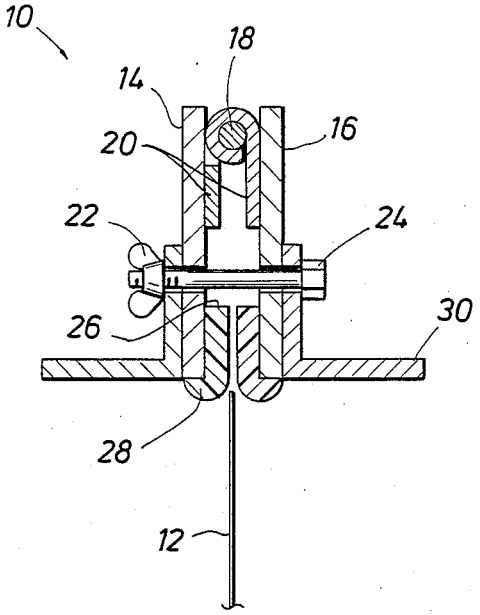
FIG. 2
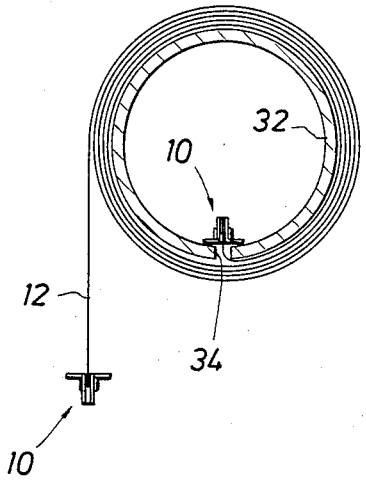
FIG. 4
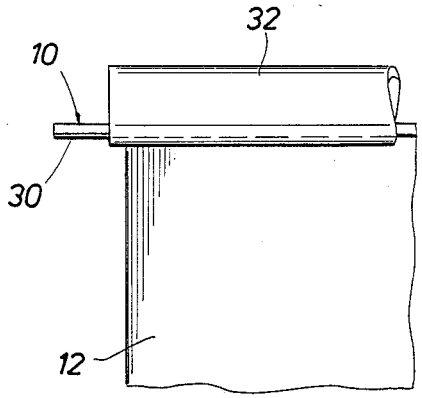
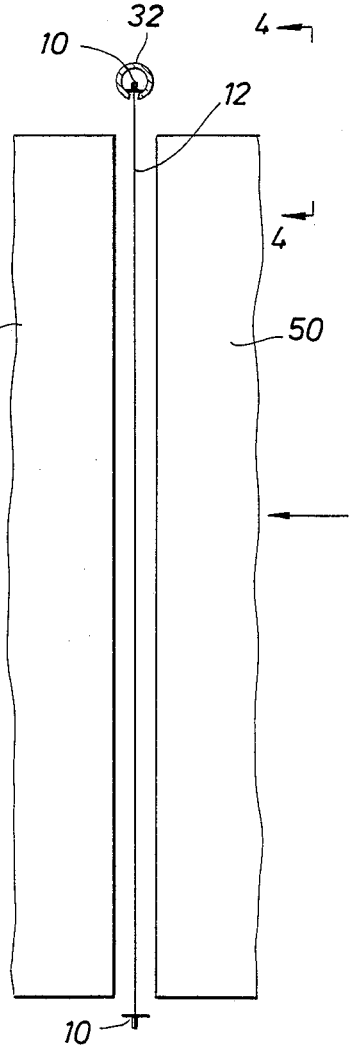
FIG. 3
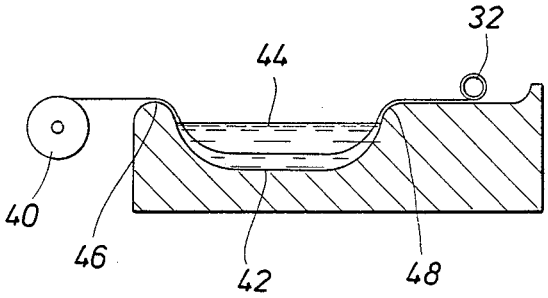
FIG. 5

METHOD AND APPARATUS FOR INSTALLING A LARGE, PLANAR, DELICATE MEMBRANE IN AN ELECTROLYSIS CELL

BACKGROUND OF THE DISCLOSURE

The present disclosure sets forth a method and apparatus for installing a membrane in an electrolysis cell. A membrane is a somewhat delicate large sheet like, pliable member of relatively thin gauge spanning an electrolysis cell. A typical membrane is a plastic body having a thickness of just a few mils (less than about 5 mils) which is very substantial in size. In large cells, the membrane might be upwards of several meters in the two major dimensions. It is a thin sheet of plastic material which is rather pliant interposed between the two halves of an electrolysis cell. In the cell, opposing anode and cathode terminals are separated by the membrane. Perhaps a description of the well known chemistry occurring in an electrolysis cell will assist in describing the nature of membrane installation.

Consider perhaps the most popular electrolysis cell, namely, a large commerical size cell from the manufacture of chlorine gas and caustic. On one side of the cell, water with NaCl is introduced. An electric current flows across the membrane in the cell between the anode and cathode, the current initiating transfer of $Na^+$ ions to the cathode side. That is, the membrane must be able to transport $Na^+$ across the membrane. By direct inference, the membrane must be pervious to the migration of $Na^+$ ions thereby suggesting that it have suitable ionic migration passages through it.

The membrane is placed between the two halves of the elctrolysis cell. In large size cells, they may be described generally as rectangular housing members which frame the membrane. So to speak, the membrane is stretched across one half of the cell and the other half is clamped against it. The two halves thus resemble rectangular frames with borders to define the internal cavity. The membrane must be clamped around the periphery so that the membrane fully spans, requiring all flow to be through the membrane, and thereby preventing leakage around the membrane. The membrane must maintain integrity, meaning there must be no tears or perforations in the membrane. Consider a typical large scale commercial electrolysis cell. Assume that the membrane when installed is as large as a bed sheet. Typically, the two rectangular frame members which clamp against the membrane must first be separated after draining the cell and the previous membrane is removed. After removal, the new membrane must be placed between the two halves. Assume that the two halves are quite large measuring several meters in the two major dimensions. The large frame members which comprise the electrolysis cell must be guided apart and guided back toward one another; this is because they are relatively heavy and must be mounted for movement on rails, guides, or tracks. They are separated only by a few centimeters. After separation, the new membrane is then placed between them and they are closed against one another. The membrane is positioned where it can be stretched taut in the fashion of a drum head. While high tension is not required, the membrane must be installed in a wrinkle free fashion. Based on the 1985 cost of membrane material, membranes can cost several thousand dollars. Even the tiniest snag will tear such an expensive membrane which really does not admit of repair. Moreover, the requirement for safe installation dictates the necessity that the membrane be installed free of wrinkles and pulled taut with a measurable degree of tension. Excessive tension cannot be permitted; hand held tension is perhaps difficult to control.

The membrane is normally supplied in sheet stock. So to speak, it can be supplied in a spool of material and cut to size. Even so, this does not prepare a membrane for instantaneous installation. Rather, the membrane is initially moistened in most instances. The manner and mode in which this is accomplished may vary depending on the material of the membrane and the nature of the electrochemical process undertaken in the cell. Using as one example a membrane manufactured by DuPont and sold under the trademark Nafion, this sheet like member typically measuring less than about 5 mils in thickness must first be soaked. It must be soaked in caustic preliminary to installation in a chlor-alkali cell. Soaking weakens the membrane structurally. That is, it is more resistant to puncture or tear when it is dry. Yet, it must be installed after wetting. This poses an additional problem in handling. One approach heretofor used simply required substantial hand labor as many personnel grab the membrane around the edges and guide it into a horizontal posture to enable the membrane to be transported from the soaking facility to a location where it is then hung vertically in the cell. In most instances, the membrane must be installed hanging vertically between the two cell halves which frame or bracket the membrane. By hand transport, the membrane, soaked in caustic, must be gently deployed with one edge dropping in the narrow slot between the two halves of the electrolysis cell. This is no easy feat, namely gently deploying a delicate sheet membrane of substantial size (almost negligible weight) where the bottom edge is lowered gently through a relatively narrow slot between facing rectantular frame members. Once it has been positioned vertically, it still must be properly aligned to assure that the marginal surplus around the four edges is properly distributed. That is, the membrane must be located so that a slight marginal excess is located around all four sides of the rectangular electrolysis cell. This may require last second positioning adjustment. The repositioning necessary to accomplish this runs the risk of distorting the shape of the membrane with wrinkles or excessive tension. It is hard to do with hand held membrane positioning procedures.

The method of the present disclosure enables the membrane to be handled from the time of wetting to the point at which it is stretched vertically in the narrow confines of an electrolysis cell, suspended wherein the lower edge hangs below the bottom of the cell and yet where the top edge extends above the top of the cell. This is an installation procedure which enables the delicate membrane to be transported, installed and stretched without the risk of hand held procedures. It is a procedure showing great advantage over devices known in the prior art which do not suggest the method of installation herein disclosed. For instance, U.S. Pat. No. 2,311,245 sets forth a clamping assembly used in stretching or drying curtains or other fabrics. However, given the sense of clamping taught by this structure, there is no suggestion whatsoever of the procedure as will be described. Another exemplary reference is found in U.S. Pat. No. 4,147,257. This reference also shows a marginal edge clamping structure. Of similar import, U.S. Pat. No. 3,364,528 also shows a multiple sheet clamping device.

By contrast, the method and apparatus of this disclosure set forth a method and means for handling delicate pliable sheet membranes of large dimension with a view of spooling a wet membrane onto a transport cylinder where it is wrapped around the transport cylinder in multiple wraps for ease of transportation, thereby enabling the transport cylinder to be moved from the location where the membrane is stored when wet and the location of the slightly opened electrolysis cell. In addition to the transport cylinder, two parallel edges of the membranes are clamped by stiff marginal clamps extending longer than the dimension so clamped, thereby extending at the ends. The clamps are equipped with end located handles for ease of manipulation. The two edges are then deployed with respect to the transport cylinder, one being stored within the cylinder so that the membrane is rolled around the cylinder for ease of transportation. Over the electrolysis cell, it is unrolled with the lower edge dropped through the electrolysis cell, thereby positioning the membrane in the electrolysis cell with a controlled measure of tension determined by the weight of the clamp member across the bottom edge. This enables the device to be used to momentarily transport and then deploy the membrane whereupon the membrane is clamped by closing the two halves with the cell and then the transport cylinder and clamps can be removed from the membrane after installation on closing the cell halves.

DETAILED DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is an end view of a marginal clamp mechanism attached to the edge of a sheet membrane for ease of transportation;

FIG. 2 shows a transport cylinder having a lengthwise slot therein wherein the cylinder supports the membrane which is spooled therearound, and further shows duplicate marginal clamps of the sort shown in FIG. 1 clamped to opposing edges of the membrane;

FIG. 3 shows the membrane placed between halves of the electrolysis cell through the method of the present disclosure;

FIG. 4 shows one corner of the membrane supported by the marginal clamp and captured along one edge in the transport cylinder; and FIG. 5 shows a method of supplying the membrane material from a supply spool into a tank to enable the membrane to be soaked in a preparatory bath and also showing a method step for spooling the membrane onto the transport cylinder.

DETAILED DESCRIPTION OF THE PREFERRED EMBODIMENT

A membrane is a device used as a separator in an electrolysis cell. Such a membrane is typically a large rectangular sheet somewhat in the fashion of a bed sheet. It may well have the stiffness of a bed sheet and is fairly large in two dimensions in the same fashion. It is relatively thin, the thickness being measured by just a few mils. There are varieties and types of membrane materials but one known material is the DuPont product sold under the trademark Nafion. The pliable and somewhat delicate membrane material can be cut to size. The membrane is placed in an electrolysis cell as previously mentioned, typically held on the two faces by rectangular cell frames. In laboratory size, the cell can be quite small, but in large commercial plants it is substantially large, typically on the order of a bed sheet and being even larger. The major dimension can measure several meters.

The very delicate material which forms the membrane must be handled in a delicate fashion and yet must be installed in massive machinery which is opened only slightly. As will be described the two halves which constitute opposing sides of the electrolysis cell might be opened by perhaps ten or fifteen centimeters. That narrow slot is the access available so that the membrane can be lowered gently through the slot and thereby positioned prior to closing the two halves of the electrolysis cell to clamp the membrane around the edges. Since the cell is a rectangular construction, the membrane preferably matches the size of the cell with an additional marginal extension of perhaps a few centimeters on all four sides of the rectangular cell. The membrane will thus be described as having top and bottom edges which are parallel edges typically being longer than the vertical height of the membrane.

Along the top edge, the clamp means 10 has a length greater than the length or major dimension of the membrane. A membrane 12 is shown in FIG. 1 and is clamped in the clamp 10. Assume that the membrane has a length along that particular edge of six meters. The clamp 10 is rigid so that it can hold the membrane, and has a length which is somewhat greater than six meters so that the clamp extends at both ends longer than the membrane 10. The added length at each end might be in the area of about 15 to 20 centimeters just to provide sufficient additional length for ease of handling. The clamp is constructed with parallel identical side plates 14 and 16. The side plates are made of bracket stock or the like and are joined together by a piano hinge 18. The piano hinge preferably extends the full length of the clamp mechanism to pull the plates 14 and 16 together. The hinge 18 is constructed with hinge plates 20 which are bolted or welded to the opposing inside faces of the plates 14 and 16. This enables the structure to open about the axis of the hinge 18. It is shown in FIG. 1 in the closed condition. At multiple locations along the length of the clamp means 10, there are a number of holes drilled through the opposing plates 14 and 16. A bolt preferably equipped with a thumb screw head is fastened through the holes. Thus, a thumb screw head 22 is shown in FIG. 1 and threads to a mating nut 24. By tightening the bolt, the clamp is pulled snugly shut. By unthreading, the clamp can then be opened.

It is possible to polish all the edges of the clamp to removes burrs which might otherwise snag the delicate membrane 12. Probably, a safer procedure is to equip the lower inside faces of the plates 14 and 16 with bonded resilient protective material. Preferably, it has the form shown in FIG. 1, namely an inside liner 26 which wraps around the lower edge 28. This wrap around arrangement protects the membrane from snagging on a sharp metal edge by contacting the membrane with a soft deformable plastic material. The coating can be relatively thin. Furthermore, it preferably has a smooth surface or face which permits the coating material to contact the membrane, thereby enhancing the mode and mechanism of clamping the membrane without tearing.

The clamp 10 conveniently is equipped with handles at the end of the clamp. A suitable handle is shown in the drawings, and preferably extends on both sides. For instance, an L-shaped bracket member can be attached near the ends. Such brackets are shown at 30. If the clamp is equipped with such brackets 30, they need no extend the full length. In fact, they need only be located at perhaps the 10–20 centimeter portions at the ends for ease of handling. They are merely a convenience for ease of handling so that the clamp member 10 can be handled, thereby assuring that personnel do not touch the membrane 12.

In FIG. 2 of the drawings, the numeral 32 identifies a transport cylinder. It is made of relatively thick walled plastic pipe. A slot 34 is cut along the full length. This enables the clamp 10 to be inserted into the transport cylinder 32. Typical dimensions should be considered. The length will be described as it relates to FIG. 4 of the drawings. The wall thickness is sufficient to maintain a stiff and rigid cylinder which does not bend. The slot 34 is cut sufficiently wide that the clamp 10 can be inserted through the slot. Thus, if the clamp 10 shown in FIG. 1 has a thickness of about two centimeters (this ignores the handles 30 which are beyond the end portions) then the slot 34 is preferably larger than the thickness or larger than two centimeters. This enables the clamp to be inserted through the slot 34 so that it is captured on the interior of the transport cylinder.

The diameter of the transport cylinder can be varied widely. For instance, a ten centimeter diameter provides a device which rolls up about 31 centimeters of membrane in one revolution. The transport cylinder can be increased or decreased in diameter. Generally speaking, the transport cylinder is of sufficient diameter to enable the membrane to be wrapped in multiple turns without wrinkling. This is shown in FIG. 2 of the drawings. There, the membrane has been spooled steadily and evenly around the transport cylinder to comprise N turns or revolutions. The number of turns can be varied but is a sufficient number to roll up practically all of the membrane. Thus, in FIG. 2 of the drawings, the membrane has been shown rolled in N turns around the cylinder and the lower edge is hanging free. As will be observed, the top and bottom edges are both clamped with the clamps 10, the clamps preferably being duplicate structures. As the method is described, more will be noted concerning this.

Attention is next directed to FIG. 4 of the drawings. There, the membrane 10 is shown at one corner. The transport cylinder 32 is also shown. The relative lengths of these members should be considered. Assume that the membrane 12 is one meter in length. The transport cylinder 32 is preferably longer as for example 10 or 15 centimeters longer at each end. This assures that the membrane is supported when rolled around the transport cylinder 32. The clamp 10 is longer yet. This permits the clamp to extend from the ends of the transport cylinder, preferably at both ends. This also enables the protruding handle 30 to extend to the side free and clear of entanglement with the transport cylinder. Even if the handle is so long that it forbids entry through the slot 34 in the cylinder 32, the clamp can be moved through the slot by simply raising the clamp 10 to pass through the slot by positioning the handles 30 outboard of the cylinder 32. Restated, the assembled relationship shown in FIG. 4 is achieved by moving the transport cylinder downwardly whereby the clamp 10 is slotted through the lengthwise, bottom located slot 34 in the cylinder. This type of arrangement best shown in FIG. 4 is the position of the components before the membrane 12 is rolled around the transport cylinder. By hand manipulation, the clamp 10 can be held on the interior of the cylinder 32 and the cylinder rotated to spool the sheet member onto the exterior in the fashion shown in FIG. 2.

Attention is now directed to FIG. 5 of the drawings. Assume that a large spool of bulk membrane material is supplied, the spool being indicated at the numeral 40. The material is spooled from the supply spool and delivered into a shallow container 42. The container 42 holds a liquid bath for moistening the membrane. The bath 44 is selected to prepare the membrane for use. In a chlor-alkali cell, one preparation is to soak the membrane in a strong caustic solution. The shallow container 42 is constructed with very smooth edges at 46 and 48. This assures that the membrane is rolled over the edges and into the bath. Soaking is accomplished in a suitable interval. The membrane is pulled from the bath. At this juncture, it can then be clamped along one edge and spooled onto the transport cylinder 32. Conveniently, the container preferably has a surface area where the membrane is out of the liquid bath, thereby enabling personnel to clamp the edge as will be described and begin spooling the membrane on the transport cylinder. As will be appreciated, a sufficient length is spooled into the bath, then cut to define the rectangle and thereafter store it on the transport cylinder.

Attention is now directed to FIG. 3 of the drawings. There, the membrane is deployed in a vertical position in the electrolysis cell. The membrane has now been unspooled. That is, the transport cylinder 32 above which encloses the clamp 10 is supported above the gap in the electrolysis cell. Recall that the electrolysis cell is defined by facing rectangular frame members. On the left, one is identified by the numeral 48 while the opposite frame member 50 has been split from it. Typically, they are moved apart by means of a suitable motor or other mechanism. They are quite heavy and therefore are preferably guided on tracks. As they are moved apart, they define a gap therebetween. Thus, the members 48 and 50 are large metal rectangular facing plates which are hollow, defining rectangular frames. So to speak, they define the electrolysis cell on the interior and are therefore open across the inside faces.

As shown in FIG. 3, assume that the members 48 and 50 have equal height and are three meters tall. In this arrangement, the membrane 12 must be more than three meters in height. As shown in FIG. 3, the membrane hangs below and extends above to provide marginal edges. The amount of extra clearance is variable but is sufficient to enable the clamps to be fastened to the parallel edges. The two halves at 48 and 50 are closed together thereby confining the cell which is spanned by the membrane 12. When this occurs, the clamp 10 at the bottom holds a steady measure of tension in the vertical extent of the membrane 12. At the time of attaching the clamps 10 to the two edges, the material is pulled so that there is tension along each clamp. Thus, when the clamps are fixed to the facing edges, the membrane is deployed with controllable tension. This assures that wrinkles are not clamped and thereby placed in the membrane. A wrinkle under either clamp will radiate outwardly with distortion. Through the use of the two clamps and with subsequent vertical hanging in the fashion shown in FIG. 3, wrinkles can be shaken out of the membrane and the membrane can then be installed with a controlled measure of tension to thereby properly span the electrolysis cell.

A sequence of operation should be considered. As an example, when the cell requires a new membrane, the cell halves 48 and 50 are separated. This typically will provide a gap measuring only a few centimeters in width. Simultaneously, the spool 40 is rotated to extend the sheet membrane into the bath 44. Soaking as required is accomplished. The membrane is soaked to an adequate measure in a suitable bath. The edge is pulled from the bath 44 and the clamp 10 is affixed. It is fastened by first loosening the bolts 22 and thereafter clamping them with finger application. This pinches or captures the edge of the membrane 12. Before tightening, the membrane 12 is tugged at opposite edges to assure that no wrinkles are caught in the clamp mechanism 10. After the attaching the clamp mechanism 10 it is then slotted into the transport cylinder 32. Recall that the protruding handles are located beyond the ends of the cylinder 32. Then, the necessary length of wet membrane is rolled onto the transport cylinder. The proper dimensions are determined by cutting the membrane at some length from the spool and the remaining or parallel edge is also clamped. Thus, the two clamps are attached, one being caught in the transport cylinder and the second being located at the far edge.

The greater portion of the membrane 12 is rolled into N turns around the cylinder. The bottom edge is then permitted to hang free with tension determined by the weight of the clamp 10, see FIG. 2. At this juncture, the handles 30 can be used to enable two people to carry the transport cylinder supporting the wet membrane from the dipping tank shown in FIG. 5 to the location of the electrolysis cell. The transport cylinder 32 is positioned above the slot between the members 48 and 50 comprising the electrolysis cell. Recalling that the gap is relatively small, the transport cylinder is carefully unspooled to gently and slowly drop the lower edge of the membrane 12 through the slot. The unspooling process is observed carefully to assure that the membrane is not bumped against any rough surfaces or edges. It is lowered, rotating the cylinder until the cylinder has been fully rotated and the entire membrane unspooled. At this juncture, the transport cylinder can be simply lifted upwardly as shown in FIG. 3. Recall that the slot in the transport cylinder is wider than the clamping permitting upward movement. The handles 30 at the ends of the clamp do not interfere with this release step. At that point, the transport cylinder can be laid aside. Then, the two personnel necessary for installing this membrane can maneuver the membrane in the gap simply by holding the top clamp at the two respective ends. It is raised or lowered and otherwise adjusted in position to then permit the electrolysis cell components 48 and 50 to be closed together in a pinching movement. Before closure, the membrane is positioned to assure that there is a marginal edge of membrane material on all four sides. After closure, the clamps 10 can then be removed because the membrane is then being held by clamping action from the electrolysis cell components. This enables release and retrieval of the clamp members. Moreover, assurance is obtained that the membrane is installed with a proper measure of vertical and horizontal tension. Thereafter, the equipment can be reused to load another membrane in a similar electrolysis cell.

The installation process enables easier transport than by hand manipulation. In effect, the membrane is not really moved by operator hand contact. Moveover, tension would appear to be much more uniform than the situation obtaining with hand manipulation without aid of clamps. Otherwise, many personnel are required to handle a large sheet like member and particularly to suspend it over the gap in the electrolysis cell and snake the sheet like member (moistened with the wetting material) into the cell.

As will be understood, the present apparatus can be adapted to various sizes. Such size changes will typically be manifest by extending or shortening the length of the transport cylinder in the respective clamps.

While the foregoing is directed to the preferred embodiment, the scope is determined by the claims which follow.

What is claimed is:

1. Apparatus for installing a rectangular sheet membrane in an electrolysis cell formed of facing halves openable to define slot in the cell, comprising:

(a) first and second similar marginal releasable clamps fastenable to a sheet membrane at opposing edges, each of said clamps including adjustable lock means on said clamps to releasably lock said clamps;

(b) axially hollow elongate transport spool means having a lengthwise slot sized to receive one of said clamps axially therein while holding the sheet in the slot to thereby anchor one edge of the sheet membrane, and further enabling the sheet membrane to be rolled around said spool means exposing a second marginal edge parallel to said spool means and wherein said remaining clamp is enabled to be releasably clamped on the second and exposed marginal edge of the sheet membrane.

2. The apparatus of claim 1 including champ handle means for handling the sheet membrane.

3. The apparatus of claim 1 including two smooth internal, inside champ faces formed of resilient material.

4. The apparatus of claim 1 including an elongate piano hinge pivotally positioning two facing, parallel frame members defining said clamp.

* * * * *